United States Patent [19]

De Crane

[11] Patent Number: 4,578,924

[45] Date of Patent: Apr. 1, 1986

[54] BAG CLOSING AND SEALING MACHINE

[76] Inventor: Charles E. De Crane, 802 Janna St., West Monroe, La. 71291

[21] Appl. No.: 524,656

[22] Filed: Aug. 19, 1983

[51] Int. Cl.[4] ..... B65B 7/04; B65B 7/08; B65B 51/18

[52] U.S. Cl. ..... 53/379; 156/443

[58] Field of Search ..... 53/375, 373, 371, 379, 53/378; 156/442.1, 443

[56] References Cited

U.S. PATENT DOCUMENTS

| | | | |
|---|---|---|---|
| 3,167,897 | 2/1965 | Hopkins et al. | 53/371 X |
| 3,218,961 | 11/1965 | Kraft et al. | 53/373 X |
| 3,381,448 | 5/1968 | Ayres et al. | 53/373 |
| 3,488,244 | 1/1970 | Lepisto | 53/373 X |
| 3,706,177 | 12/1972 | Willett | 53/373 X |
| 3,875,726 | 4/1975 | Harris et al. | 53/371 X |
| 4,191,004 | 3/1980 | Gmuer et al. | 53/378 |

*Primary Examiner*—Horace M. Culver
*Attorney, Agent, or Firm*—Norvell E. Von Behren; Donna J. Thies

[57] ABSTRACT

A bag closing and sealing machine is disclosed for closing and sealing stepped end adhesively sealed type bags. The machine is designed to allow a separation at the axial center line of the machine whenever a bag jam starts to occur. By providing for axial separation, lengthly and costly dismantling of the machine to clear a jam-up is eliminated. The machine comprises three primary sections which are a feeding and creasing section, a folding and heating section and a compression section. The various sections are fixedly attached partly to a fixed elongated frame and partly to a pivotable elongated frame in the preferred embodiment. In a modification of the preferred embodiment, the pivotable elongated frame is replaced by a slidable elongated frame to function in a similar manner. A method of quickly and easily releasing a jammed stepped end bag from the machine is also disclosed. The pivotable elongated frame may be also designed to slide or move away from the fixed elongated frame by various means such as by electric motor drive, worm gear drive, hydraulic or air cylinder drive, hand cranking or by manual pulling among other ways within the spirit and scope of the invention.

12 Claims, 20 Drawing Figures

BAG CLOSING AND SEALING MACHINE

BACKGROUND OF THE INVENTION

This invention relates to a bag closing and sealing machine in general and in particular to a new and novel bag closing machine for use on a stepped end adhesively sealed bag.

It is known in the prior art to provide various types of bag closing and sealing machines having the necessary feeding and creasing sections in combination with folding and heating sections and compression sections for closing and sealing a stepped end adhesively sealed bag known in the art as a pinch style bag. Bags of this type are typified by the multi-wall bags containing charcoal, ice and other heavy materials which may be purchased at various retail and commercial outlets throughout the country.

A typical bag closing and sealing machine for stepped end bags is shown in the U.S. Pat. No. 3,381,448, issued on May 7, 1968, to R. H. Ayres et al. This patent teaches an in-line elongated machine having the before-mentioned sections fixedly attached to a machine frame for the ultimate purpose of closing and sealing the pinch style bags.

This type machine, while successful in the market place, has had problems with jams occurring in the machine due to tracking problems of the various compression belts and due to the uncontrollable nature of folding of paper under high-speed bag operations. Due to these particular problems, jam-ups can occur in the machine shown in the patent and the removal of jammed bags requires a partial dismantling of portions of the machine to free the jammed bags. This condition may take as long as one to one-and-a-half hours depending upon the total complexity of the jammed condition and where it lies within the various sections of the machine.

Since paper bags will at times refuse to fold in the predetermined manner precisely as designed by the machines, it can be seen by referring to the figures of the drawings in the Ayres et al patent, how a jam in the various sections could result in a lengthy amount of down time to release the jam since the easy removal of a jammed bag has not been taken into consideration in design of the Ayres machine.

SUMMARY OF THE INVENTION

In order to overcome the before described problems in prior art bag closing and sealing machines, there has been provided by the subject invention a new and novel pinch bag closing and sealing machine which has new and unusual break away features that allow a jammed bag to be quickly and easily removed from within the machine. The applicant's new and novel machine is designed with a plurality of elongated sections that are attached to the frame of the machine. One section is fixedly attached to the frame of the machine while the other section is either pivotably mounted on the frame or slidably mounted as a modification of the preferred embodiment. The various before described sections used in a bag closing and sealing machine are then mounted partly on the fixed section and partly on the pivotable or slidable section to coact together during normal operation of the machine.

During a jam of a bag in the machine, a quick-release feature allows the pivotable section to pivot downwardly and out of the operative position so that the jam can be quickly removed from the machine. In the alternative, the non-fixed section can slide away from the fixed section thereby allowing the jammed bag to be quickly and easily removed from the area where the jam occurred.

Other important features added to the applicant's new and novel machine include an improved compression section wherein a poly V belt and pulley system are used to minimize belt walking which is one of the causes of jams in a bag sealing machine. The use of the poly V belt compression section in combination with the split axial machine design thereby reduces jams to a minimum and when a jam does occur, reduces the time taken for removal of the jam from the before described one to one-and-a-half hour down to approximately five minutes. In addition the applicant's new and novel design permits the various belts used in the invention to be changed with approximately five minutes down time being required for the change-over.

Accordingly it is an object and advantage of the invention to provide a new and novel bag closing and sealing machine which reduces jams within the machine by the use of an axial break away construction of the machine.

Another object and advantage of the invention is to provide a new and novel bag closing and sealing machine in which a portion of the components of the machine may be quickly and easily pivoted, moved or slid away from the remaining portion of the machine to allow the jammed condition in the machine to be eliminated quickly and with minimal down time.

A further object and advantage of the invention is to provide a new and novel bag closing and sealing machine in which a jammed bag condition is minimized by the use of poly V belts and pulleys in critical sections of the machine.

Another object and advantage of the invention is to provide a new and novel bag closing and sealing machine in which belt change-over time is greatly reduced due to the particular construction of the machine with its axial split section hereinbefore described.

Still yet another object and advantage of the invention is to provide a new and novel bag closing and sealing machine and method for quickly and easily releasing a jammed step end bag wherein a larger quantity of bags is able to be run through the machine before a jam occurs thereby resulting in more profit to the machine owner.

These and other objects and advantages of the invention will become apparent from a review of the drawings and from a reading of the hereinafter description of the preferred embodiment which has been given by way of illustration only.

DESCRIPTION OF THE PREFERRED EMBODIMENT

Figure 1:
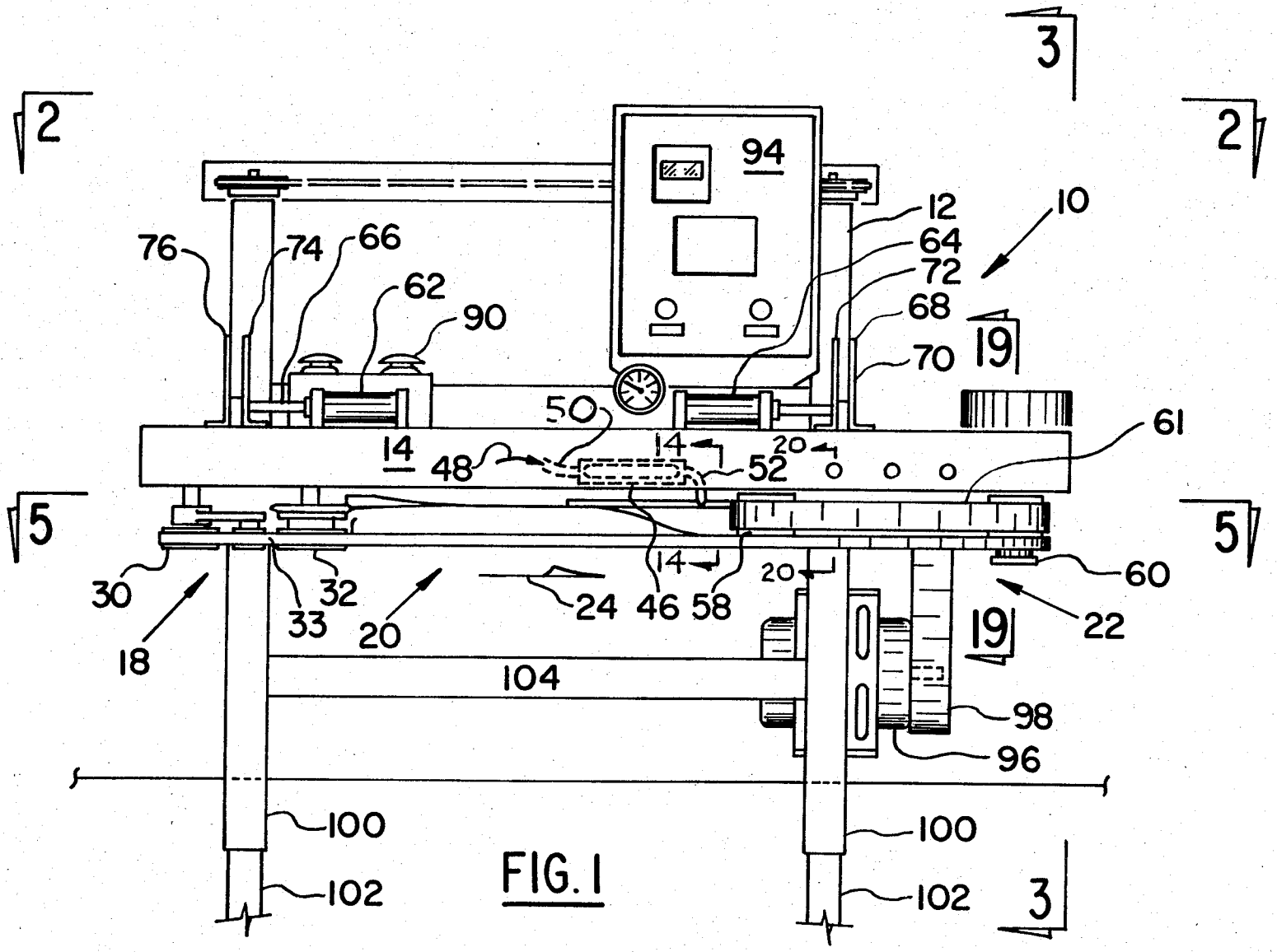
FIG. 1 is a side view of the applicant's new and novel bag closing and sealing machine.
Figure 2:
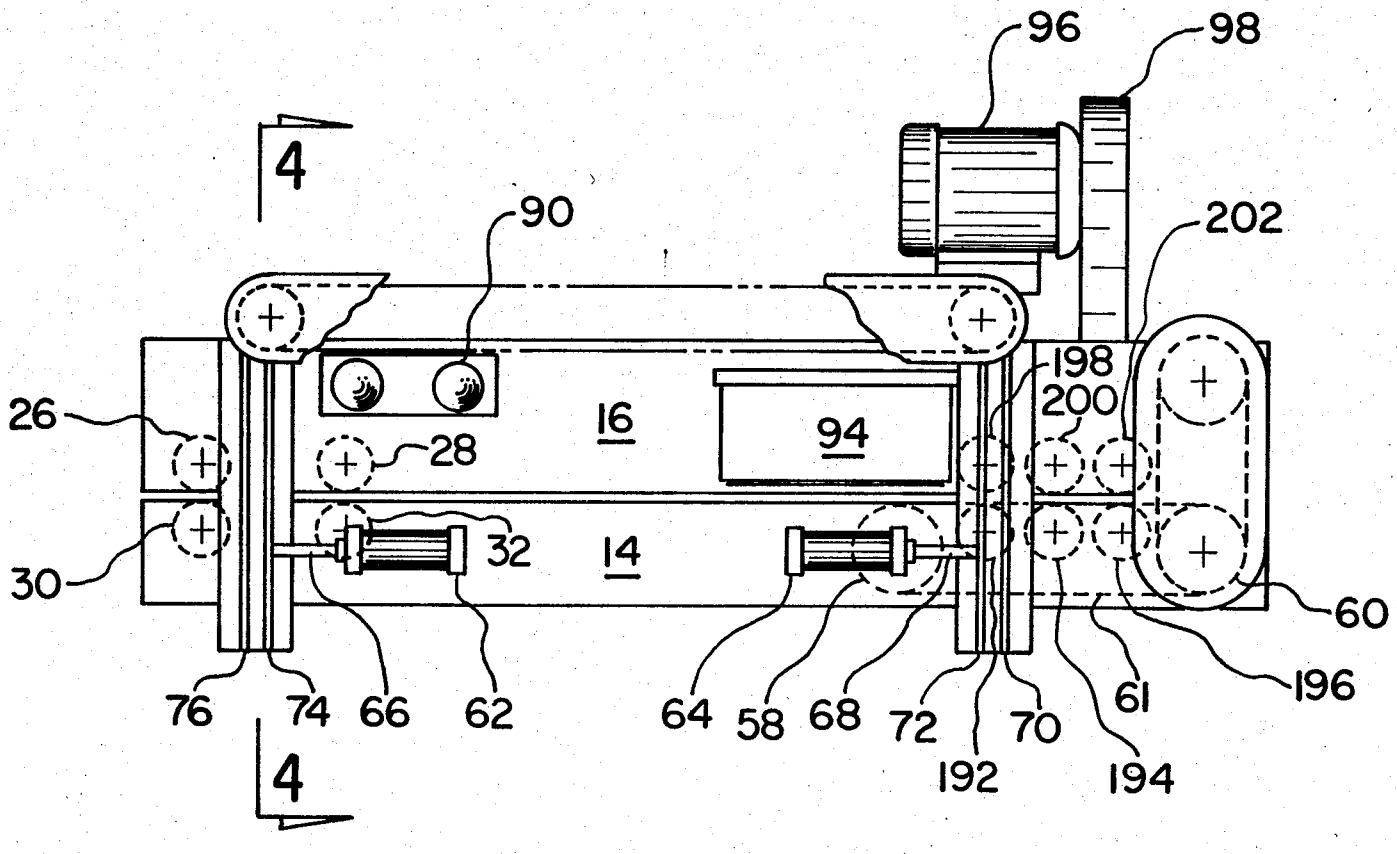
FIG. 2 is a top view, taken along line 2—2 of FIG. 1 of the applicant's machine.

Referring now to the drawings in general and in particular to FIG. 1 of the drawing there is shown the applicant's new and novel bag closing and sealing machine generally by the numeral 10 which comprises a frame 12 and a pivotable elongated section 14 pivotably attached to the frame 12 and in juxtaposition to a fixed elongated section 16 shown more clearly in FIG. 2 of the drawings. The fixed elongated section 16 is fixedly attached to the frame. The pivotable elongated section 14 in combination with the fixed elongated section 16 contains the three prime portions of the applicant's machine which are a feeding and creasing section shown generally by the numeral 18, a folding and heating section shown generally by the numeral 20 and a compression section shown generally by the numeral 22.

The three sections before named are positioned so that a bag entering the feeding and creasing section 18 will travel in the direction shown by the arrow 24 progressing downstream to the folding and heating section and finally through the compression section where the stepped ends of the bag are adhesively sealed together whereupon the bag is then removed from the applicant's new and novel bag closing and sealing machine.

Figures 5, 6, 7, 8, 9, 10, 11, 12, 13:
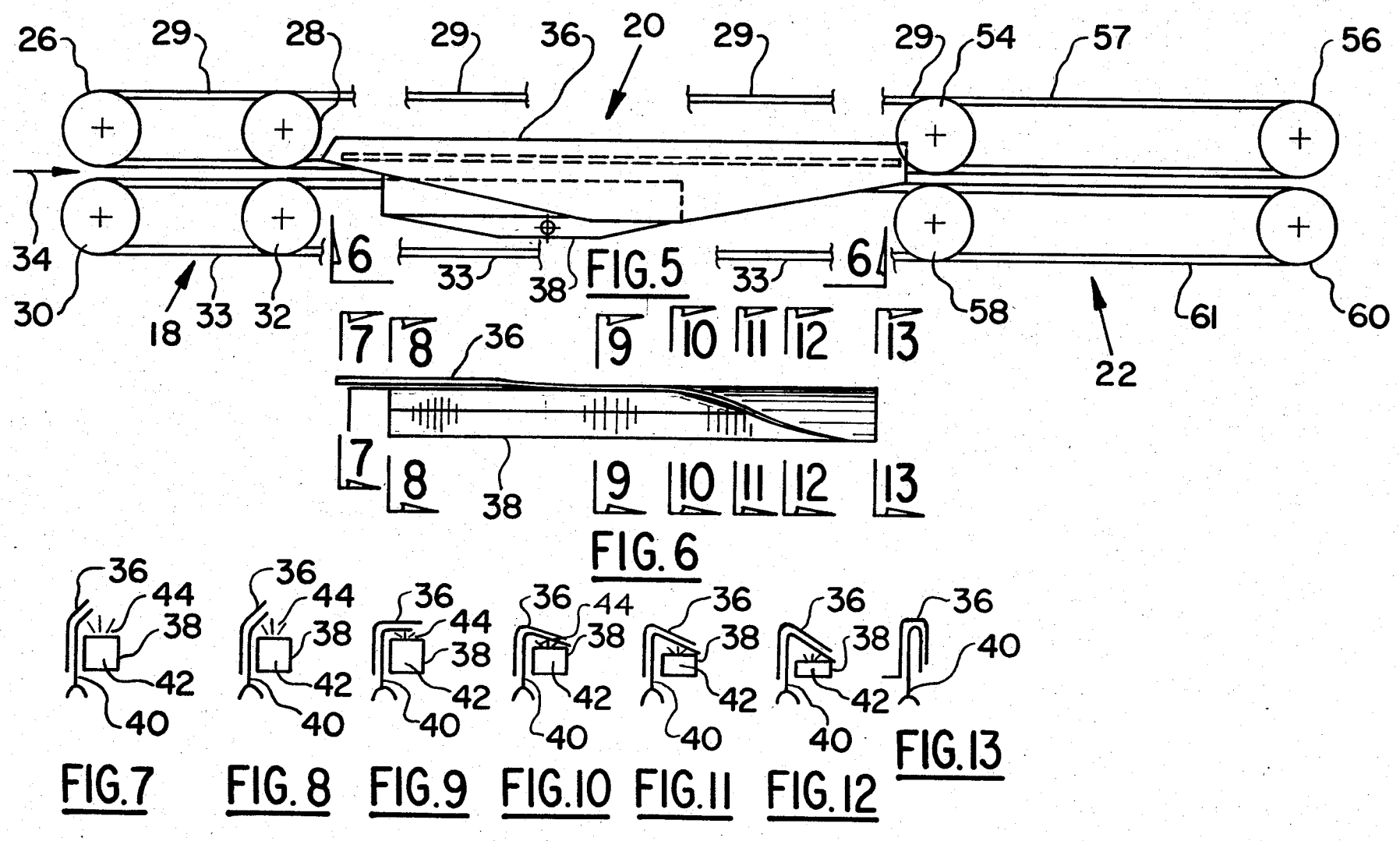
FIG. 5 is a top schematic view of the applicant's complete machine showing the three prime sections of the machine and showing in greater detail how the bag is creased and folded through the machine.
FIG. 6 is a side view taken along line 6—6 of FIG. 5 showing in greater detail the folding section of the machine.
FIGS. 7, 8, 9, 10, 11, 12 and 13 are cross-sectional views taken through lines 7—7 to 13—13 of FIG. 6 showing how the folding progresses in the folding section.

Referring now to FIG. 5 of the drawing there is shown a top schematic view of the applicant's complete machine showing the before mentioned three prime sections of the machine and showing in greater detail how the bag passing through the machine would be creased and folded prior to entering the compression section 22. The feeding and creasing section would comprise a pair of pulleys 26 and 28 which would be attached for rotation to the fixed elongated section 16 and would be driven by a belt 29. The feeding and creasing section would also comprise a pair of pulleys 30 and 32 which would be attached for rotation to the pivotable elongated section 14 and would be driven by a belt 33 of the type known in the art. A stepped end bag entering the machine would enter in the direction shown by the arrow 34 and would pass between the two portions of the feeding and creasing section as shown in FIG. 5 of the drawing. Should a jam occur in this section, then the set of pulleys 30 and 32 along with the V belt 33 could be pivoted out of position as will be described more fully hereinafter to release the jam from this section.

After the stepped bag passes through the feeding and creasing section 18, it will pass through the folding and heating section 20 to be folded downwardly to its sealed position prior to entering the compression section. The folding and heating section 20 comprises an elongated folding rail 36 which is fixedly attached to the fixed elongated section 16 and contains a heating portion 38 which is fixedly attached to the pivotable elongated section 14.

When constructed in this manner, as a stepped end bag passes through the folding and heating section 20, should a jam occur in this section, then the heating portion 38 of the section is able to be pivoted downwardly and outwardly as will be described more clearly hereinafter to easily release the jammed bag from this section. For purposes of clarity in the schematic view shown in FIG. 5 of the drawings, only one unit of a two-heating-portioned unit 38 has been shown in solid lines in FIG. 5. A second heating portion may be used downstream of the first heating portion 38 should it be desirable to split the heating portion in two pieces. When constructed thusly the second heating portion would also be attached for rotation to the pivotable elongated section 14 and would be designed to be able to swing downwardly and outwardly away from the folding rail 36 thereby allowing a jammed bag in the folding and heating portion 20 to be quickly removed from that portion.

For purposes of clarity then FIG. 5 has been shown with the folding and heating portion 20 having at least one heating portion 38 and possibly a second heating portion 39 as desired while FIGS. 7 through 13 have been shown as if the folding and heating section 20 were constructed with a single elongated heating portion formed as a single unit encompassing heating portions 38 and heating portions 39. When the stepped end bag passes through the folding and heating section 20 it can be seen how a heating section 38 or 39 will then function as the folding rail 36 folds the bag 40 downwardly to its folded position. The heating portions 38 and 39 would have heated air passing through the central section 42 which would pass through the top portion of the heating portions 38 and 39 to be expelled out through openings in the top portion. In FIG. 7 the heated air would be numbered 44 as it passes through the openings in the top of the heating portions 38 and 39 and would serve to melt the hot-melt adhesive previously formed on stepped end bags in the bag construction operation.

As the folding rail 36 then folds the bag ends downwardly, the heating continues throughout the heating portions 38 and 39 until the bag ends are finally closed and ultimately sealed as the bag 40 passes through the compression section 22. FIGS. 7 through 13 are cross-sectional views taken along lines 7—7 through lines 13—13 of the folding rail section showing in schematic form the folding and heating to activate the stepped end bags hot-melt adhesive prior to the entering of the compression section.

The heating portions 38 and 39, constructed thusly, form hot air manifolds which are heated by separate heating elements 46 shown in greater detail in FIG. 1 of the drawing. The heating elements are capable of being raised to approximately a 1900° F. temperature by known electrical means and would circulate a plant air source 48 coming into the heating element 46 at approximately 6 PSI at a rate of 10 cubic feet per minute. The plant air 48 enters in through the air inlet 50 and through the heating element 46 where it passes through the air outlet 52 into the heating portion 38 or heating portion 39 as constructed. The normal outlet air temperature for a pinched-style bag coming through the heating portion or 38 at 44 would be in the range of 325° F. to 500° F. in order to activate the hot-melt adhesive on the stepped end of the pinched-style bag.

Returning now to FIG. 5 of the drawing there will be described the compression section 22 of the applicant's new and novel bag closing and sealing machine. A pair of poly V belt pulleys 54 and 56 are attached for rotation to the fixed elongated section 16 and are rotated by means of a poly V belt 57. A second set of poly V belt pulleys 58 and 60 are mounted for rotation to the pivotable elongated section 14 and are rotated by the poly V belt 61. As a bag 40 passes through the compression section 22, should a jam-up occur in this section, then the entire compression section may be quickly pivoted downwardly and outwardly as will be described more fully hereinafter to quickly and easily release the jam from that section.

When the applicant's bag machine is constructed, the pivotable elongated section 14 may be constructed in a one-piece construction so that all three prime sections 18, 20 and 22 may be pivoted as a unit as taught in the preferred embodiment. It is within the spirit and scope of the invention that the pivotable elongated section 14 may also be constructed in a one, two or three-piece construction so that each prime section 18, 20 or 22 may be pivoted downwardly and outwardly as desired either individually or in combination with other sections. Modifications may be made in the preferred embodiment as shown to accomplish this within the spirit and scope of the invention should it be desired by the purchaser of the machine to have individual pivotable sections.

In the drawings shown in this application, a single pivotable elongated section is shown and it is within the abilities of the designer to redesign the machine to provide for a split two or three-piece pivotable section having the teachings of the applicant's invention before him.

It is also within the spirit and scope of the invention that the applicant's pivotable elongated section 14 could be designed to slide or move away from the fixed elongated section 16 as will be shown in more detail hereinafter to allow the applicant's new and novel bag closing and sealing machine to function in a similar manner to the pivotable version. Should a movable version be constructed, then it is also within the spirit and scope of the invention that the movable portion could be constructed in a one, two or three-piece slidable section so that the prime sections 18, 20 and 22 can either be moved away from the fixed elongated section 16 singly or individually as desired by a purchaser of the machine.

Figure 4:
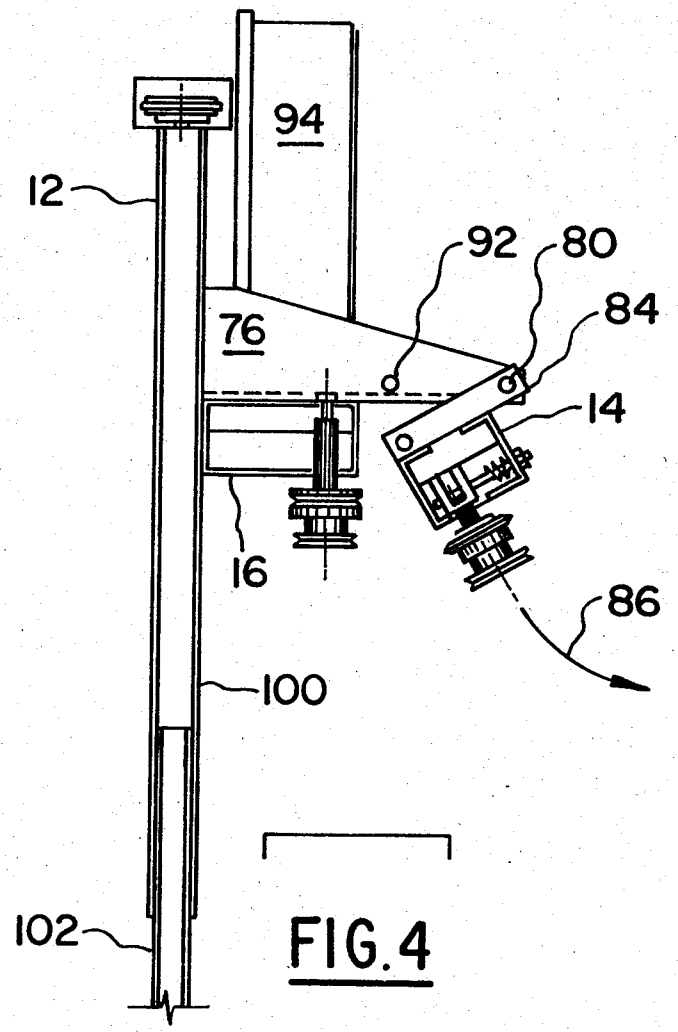
FIG. 4 is a sectional view, taken along line 4—4 of FIG. 2 showing the one elongated section pivotably repositioned to a non-operative position.
Figure 3:
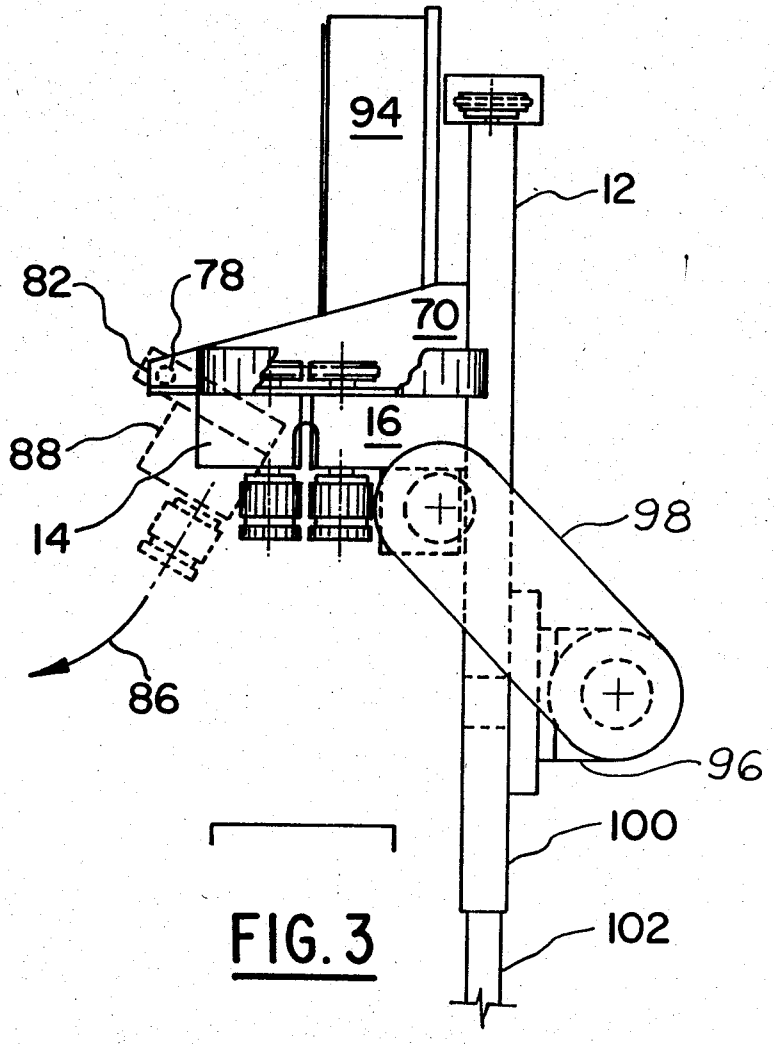
FIG. 3 is an end view, taken along line 3—3 of FIG. 1 showing the applicant's machine.

Referring now to drawing FIGS. 2, 3 and 4 there will be shown in more detail how the applicant's pivotable elongated section 14 is positioned in juxtaposition to the fixed elongated section 16 and how the two sections function together during normal operation of the machine and during occurrence of a jam in any section of the unit.

In FIG. 2 it can be seen how a pair of break-open cylinders 62 and 64 may be positioned on or over the pivotable elongated section 14 and have elongated pins 66 and 68 connected to the cylinders designed for engagement with an extension of the frame 12. The frame extension is shown more clearly in FIGS. 3 and 4 of the drawing which comprises a pair of cantilevered arms 70, 72, 74 and 76 which would be welded to the vertical portion of the frame 12 to extend above both the pivotable elongated section 14 and the fixed elongated section 16. As has been before mentioned the fixed elongated section 16 would be fixedly attached to the cantilevered arms 70, 72, 74 and 76 by welding or bolting or some other suitable attaching means. The break-open cylinders 62 and 64 may also be positioned on the fixed elongated section 16 to function in a like manner. The break-open cylinders may also be positioned as shown in FIG. 2 and may be cantilevered off of a horizontal member (not shown) which is in turn fixed to the fixed elongated section 16.

By referring to FIGS. 3 and 4 there can be seen how the pivotable elongated section 14 is designed to pivot around a pair of pins 78 and 80 which are positioned through a series of holes formed in the ends 82 and 84 of the cantilevered arms 70, 72, 74 and 76. When positioned thusly it can be seen that the pivotable elongated section 14 is able to swing downwardly and outwardly as shown by the arrow direction 86 in order to be able to release a jammed bag from between the pivotable elongated section 14 and the fixed elongated section 16. The swinging of the pivotable elongated section 14 downwardly and outwardly in the direction by the arrow 86 may be by gravity, by a hydraulic or pneumatic cylinder and may also be by an electric motor within the spirit and scope of the invention.

It can be seen in comparing FIG. 3 and FIG. 4 that the normal operating position of the pivotable elongated section 14 is as shown in FIG. 3 with the dotted line representing how the pivotable elongated section 14 would be swung outwardly to relieve a jammed condition in the machine. FIG. 4 also shows the swinging of the pivotable elongated section 14 with the entire section shown in solid lines as it would be released downwardly and outwardly to free a jammed bag condition.

By referring to FIGS. 2, 3 and 4 it can then be seen how the activation of the break-open cylinders 62 and 64 by means of an activating valve 90 will permit the cylinders to retract withdrawing the elongated pins 66 and 68 from the holes 92 formed in the cantilevered arms 70, 72, 74 and 76 thereby permitting the entire pivotable elongated section 14 to swing downwardly and outwardly by gravity or other means as has been before described.

A control box 94 is mounted for easy access to the frame 12. The drive motor 96 with its attached motor drive 98 is mounted on one of the upper legs 100 attached to the frame 12. A sliding leg 102 is attached to a lower horizontal frame not shown in the drawing which rests upon the floor below the applicant's bag sealing machine. By the use of the upper leg 100 and sliding leg 102 it can be seen how the entire structure may be raised vertically to adjust to a particular bag height and the bag line in which the machine is positioned. A cross-frame 104 is welded to the upper legs 100 to reinforce the upper leg portion of the applicant's machine.

Figure 14:
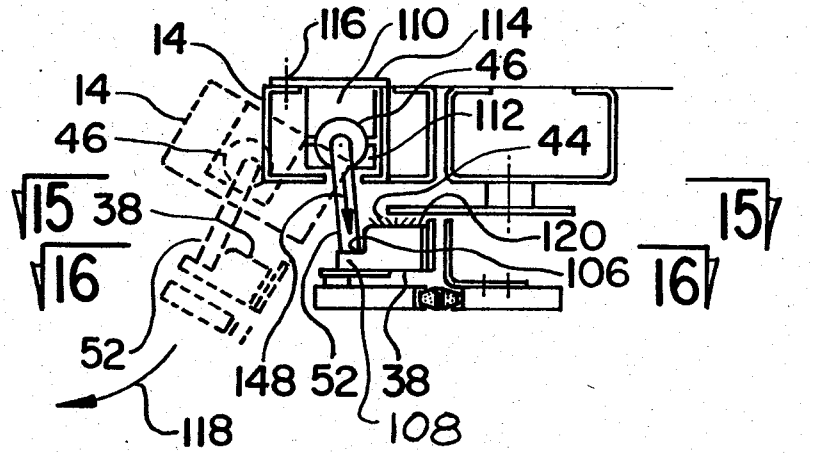
FIG. 14 is a cross-sectional view, taken along lines 14—14 of FIG. 1, showing in detail the mounting of the heating section on the applicant's machine.

Referring now to FIG. 14 of the drawing there is shown a cross-sectional view, taken along lines 14—14 of FIG. 1, showing in detail the mounting of the heating portion 38 on the applicant's machine. As has been before mentioned, the heating section is designed to be mounted on the pivotable elongated section 14 and is designed to be carried by the air outlet 52 which is connected to the heating element 46 as is shown in greater detail in FIG. 1 of the drawing. The air outlet 52 would be formed of a pipe or tube which would be welded at 106 on the end 108 of the heating portion 38. The heating element 46 would be mounted between an upper housing 110 and a lower housing 112 with the upper housing 110 being fixedly attached to a mounting plate 114 which would in turn be bolted at 116 to the pivotable elongated section 14.

When constructed thusly it can be seen how the pivotable elongated section 14 could be pivoted in the direction shown by the arrow 118 to the dashed position shown in FIG. 14 which would be the non-operative position from which a jammed bag could be released from the machine.

Figure 15:
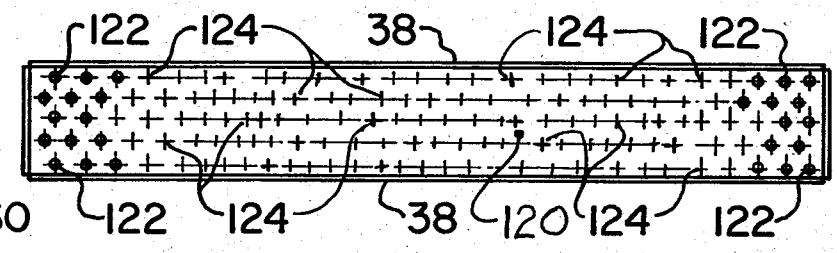
FIG. 15 is a plan view, taken along lines 15—15 of FIG. 14 showing in greater detail the top of the heating section.

Referring now to FIG. 15 of the drawing there is shown a plan view, taken along lines 15—15 of FIG. 14 showing in greater detail the top of the heating portion 38. The heating portion 38 would be formed with a top plate 120 having a plurality of holes 122 formed therein at each of the locations marked with a "+" at 124 to indicate a hole 122. Through these holes would be forced the heated air 44 as shown in FIGS. 7–13 of the drawings to activitate the heat seal on the pinch-style bag passsing through the applicant's machine.

Figure 16:
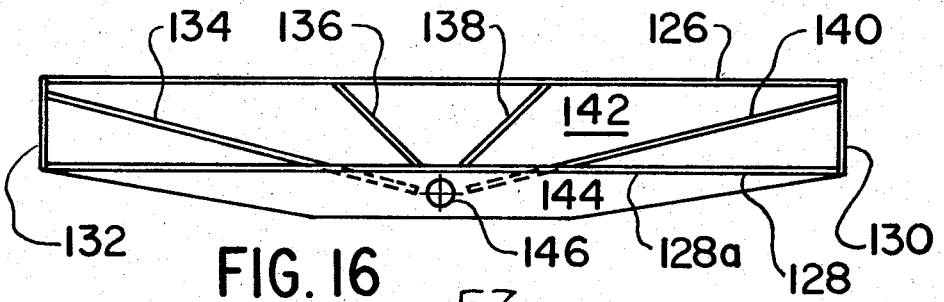
FIG. 16 is a cross-sectional view, taken along lines 16—16 of FIG. 14 showing in detail the inside of the applicant's heating section.

Referring now to FIG. 16 of the drawings, there is shown a cross-sectional view, taken along lines 16—16 of FIG. 14 showing in greater detail the inside of the applicant's heating portion 38. The heating portion comprises a back plate 126 and a front plate 128 fixedly attached together by side plates 130 and 132. A plurality of baffle plates 134, 136, 138 and 140 are fixedly attached to a bottom plate 142. A top plate 144 is fixedly attached to the front plate 128 and the front plate 128A and contains an inlet hole 146 where the air inlet pipe 52 is welded in position as has been shown in FIG. 14 of the drawings.

From this it can be seen that the heated air 44 passes through the air outlet 52 in the direction shown by the arrow 148 in FIG. 14 and passes upwardly through the heating portion 38 through the outlet holes 122 shown in FIG. 15 of the drawing. The plurality of baffle plates 134, 136, 138 and 140 evenly distribute the heating air within the heating portion 38 so that it is uniformly released from the heating portion through the outlet holes 122.

Figure 18:
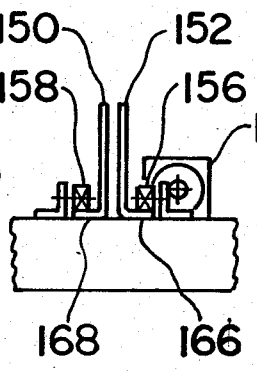
FIG. 18 is an end view, taken along line 18—18 of FIG. 17 showing the mounting of the modification of FIG. 17.
Figure 17:
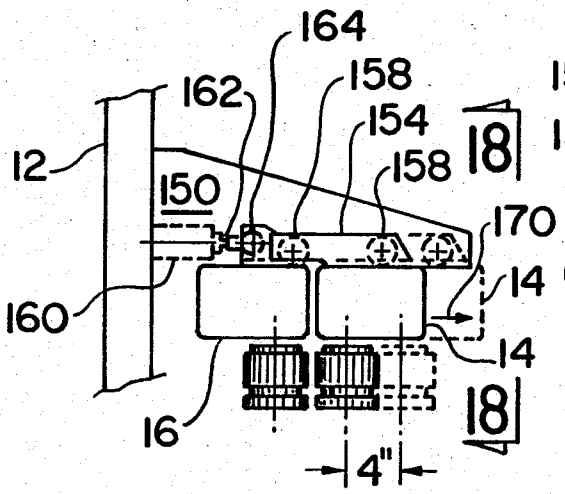
FIG. 17 is a sectional view, taken along line 4—4 of FIG. 2 showing a modification of the preferred embodiment wherein the one elongated section is designed to slide outwardly away from the fixed elongated section instead of pivoting downwardly and outwardly.

Referring now to FIGS. 17 and 18 of the drawing there is shown in greater detail the modification of the preferred embodiment wherein the elongated section 14 may be formed so that the elongated section may be designed to be slidable away from the fixed elongated section 16 instead of being designed to be pivotable from that section. It can be seen in FIG. 17 how the fixed elongated section 16 and the pivotable elongated section 14 are positioned below á cantilevered arm 150 and 152 which have been welded to the frame 12 of the basic machine. An elongated slot 154 is positioned within the cantilevered arms 150 and 152 and is designed to carry a plurality of cam rollers 156 and 158 as shown in FIGS. 17 and 18.

A break-open cylinder 160 would be positioned as shown in FIG. 17 and would have a rod 162 connected to the rod end 164 and to the plurality of cam rollers 156 and 158. A shaft, not shown in the drawings, would also rotatably mount the cam rollers 156 and 158 so that they could slide upon the upturned ends 166 and 168 of the cantilevered arms 150 and 152.

In this manner it can be seen how upon a jammed condition in the applicant's machine, the break-open cylinders 160 would be activated with air, hydraulics or some other activating means to slide the pivotable elongated section 14 in the direction shown by the arrow 170 to the non-operational position as shown by the dashed lines in FIG. 17 of the drawing. It is within the spirit and scope of the invention that a plurality of break-open cylinders 160 could be used to slide the elongated section 14 should it be desirable to form the elongated section in a one-piece construction. If the elongated section were formed in three separate sections as has been before mentioned when referring to the preferred embodiment, then also a plurality of break-open cylinders would be utilized with at least one break-open cylinder on each portion of the sectionalized elongated section 14. It is also within the spirit and scope of the applicant's invention that the elongated section 14 may be formed to pivot to a non-operating position, to slide to a non-operating position and to be moved to a non-operating position by other means within the applicant's basic concept. The applicant is not to be limited to the exact manner of moving the pivotable elongated section 14 from the operating position to the non-operating position since the manner shown has been shown by way of illustration only.

Figure 19:
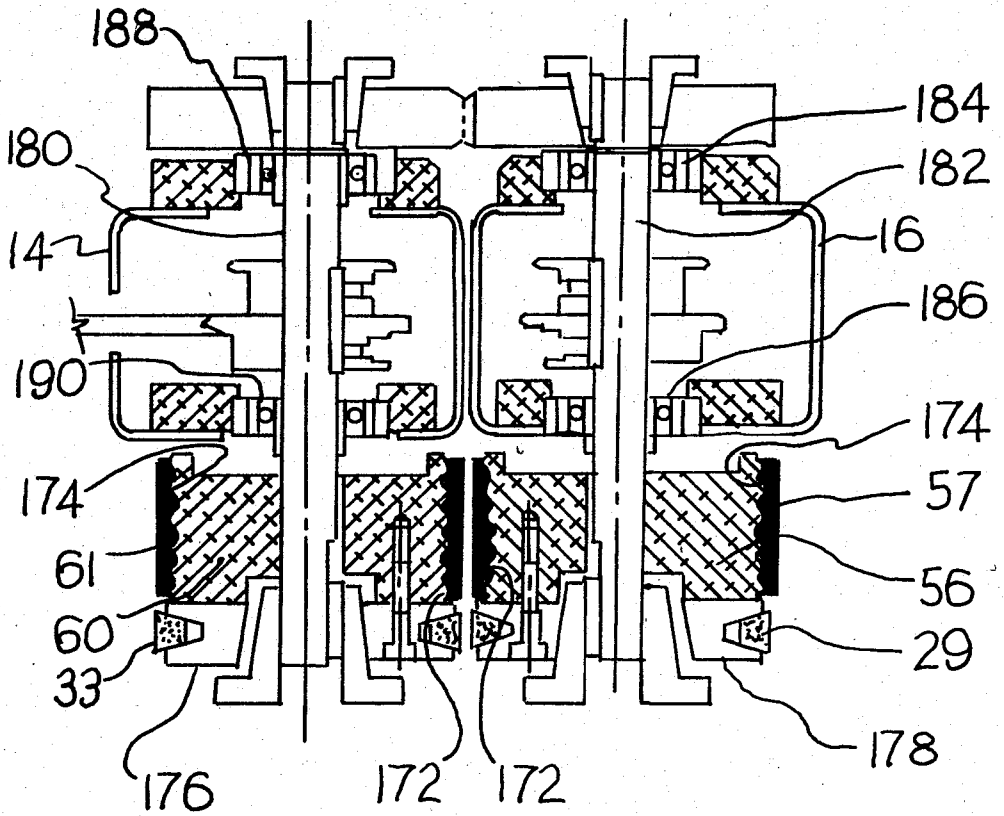
FIG. 19 is an enlarged sectional view, taken along lines 19—19 of FIG. 1 showing in detail the poly V pulley and belt used on the applicant's invention.

Referring now to FIG. 19 of the drawing there is shown an enlarged sectional view, taken along lines 19—19 of FIG. 1 showing in detail the poly V pulley and belt construction used on the applicant's basic invention. The poly V belt pulleys 60 and 56 as well as the poly V belt pulleys 58 and 54 would be constructed as shown in FIG. 19 having a series of circumferentially spaced protrusions 172 formed on the pulley which match up with similarly sized voids 174 formed on the belts 57 and 61. When formed thusly, the belts 57 and 61 will track within the poly V belt pulley thereby preventing a bag passing through the machine from riding up on the belts or having the belts ride up on the pulley. It can also be seen in FIG. 19 of the drawing and FIGS. 1 and 5 of the drawing how the belt 33 and the belt 29 of the feeding section run the entire length of the applicant's machine and run around the pulleys 176 and 178 of the machine. The pulleys 176 and 178 are rotatably attached to the shafts 180 and 182. The shafts also carry the poly V pulleys 57 and 60. The shafts 180 and 182 are rotatably mounted in the bearings 188, 190, 184 and 186 as can be seen in FIG. 19 of the drawing.

For purposes of providing more pressure through the compression section 22 of the applicant's machine there are also provided poly V pressure pulleys 192, 194 and 196 mounted on the pivotable elongated section 14 as well as poly V pulleys 198, 200 and 202 mounted on the fixed elongated section 16. For purposes of clarity these are shown by dashed lines in FIG. 2 of the drawing and have been eliminated from FIG. 5 for the same reason.

Figure 20:
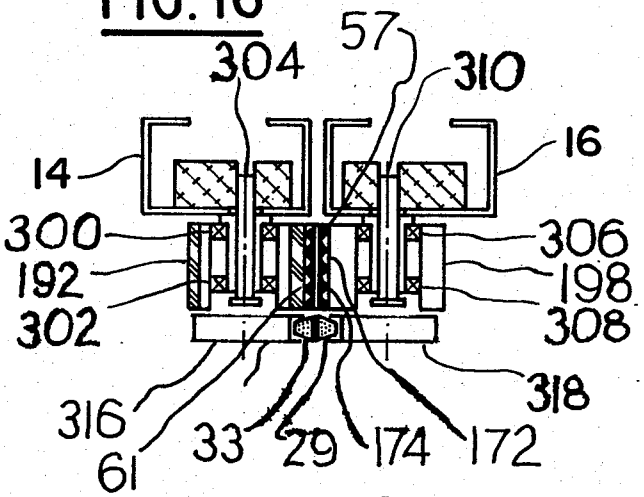
FIG. 20 is an enlarged sectional view, taken along lines 20—20 of FIG. 1.

FIG. 20 is a cross-sectional view taken along line 20—20 of FIG. 1 showing more detail on the mounting of the poly V pulleys 192, 194, 196, 198, 200 and 202. FIG. 20 shows the mounting of two of the pulleys and is taken through the adjacent pulleys 192 and 198. A pair of bearings 300 and 302 are mounted with the pulley 192 rotating thereon and are carried by the shaft 304. A pair of bearings 306 and 308 are also mounted with the pulley 198 rotating thereon and are carried by the shaft 310. The belts 29 and 33 ride in separate channels 312 and 314 mounted on the aluminum bars 316 and 318. The belts 29 and 33 run free on the opposite outside ends of the bars 316 and 318. The poly V belts 57 and 61 also run free on the opposite outside portions of their matching pulleys as shown better in FIG. 2.

From the foregoing it can be seen that there has been provided by the applicant's invention a new and novel bag closing and sealing machine which is designed to allow a separation at the actual center of the machine whenever a bag jam starts to occur. The separation may be of the entire one side of the bag machine or may be of the separate three sections of the bag machine which are the feeding and creasing section, the folding and heating section and the compression section. The separation may be activated by pivoting one, two or three of these sections and may be activated by sliding or moving one, two or three of these sections or by other means within the spirit and scope of the invention. The activation may be by means of an air cylinder, a hydraulic cylinder, an electric motor worm gear drive and also other means within the spirit and scope of the invention. It can be seen that other changes may be made in the applicant's machine and method without departing from the spirit and scope and the applicant is not to be limited to the exact manners shown in the application including the drawings which have been shown by way of illustration only.

The movable elongated section 14 can also be separated from the fixed elongated section 16 by the use of a worm gear operating mechanism of the type known in the art of worm gear movement. If constructed thusly, the turning of the worm gear to move the elongated section 14 could be mechanically controlled by a handle or by electric motor or other means within the spirit and scope of the invention. The elongated section 14 could also be slid by hand away from the fixed elongated section 16 after being unlocked from its operating position by a locking device. Other variations are possible within the spirit and scope of my invention.

Having described my invention, I claim:

1. A bag closing and sealing machine for a stepped end adhesively sealed bag, comprising:

(a) a frame;

(b) a fixed elongated section fixedly attached to the frame;

(c) a pivotable elongated section pivotably attached to the frame and in juxtaposition to the fixed elongated section;

(d) means, associated with the pivotable elongated section, for retaining the pivotable elongated section in a generally horizontal position in juxtaposition to the fixed elongated section;

(e) a feeding and creasing section fixedly attached partly on the fixed elongated section and partly on the pivotable elongated section;

(f) a folding and heating section positioned downstream from the feeding and creasing section, the folding portion being fixedly attached to the fixed elongated section and the heating portion being fixedly attached to the pivotable elongated section; and (g) a compression section positioned downstream from the folding and heating section and fixedly attached partly on the fixed elongated section and partly on the pivotable elongated section; and (h) the pivotable elongated section being designed to swing downwardly upon release of the retaining means to a non-operative position thereby easily permitting the release of a jammed bag from between the two elongated sections containing the feeding and creasing section, the folding and heating section and the compression section.

2. The machine as defined in claim 1 wherein the retaining means comprises in part at least one break-open cylinder positioned over the pivotable elongated section and having at least one elongated pin designed for releasable engagement with the frame.

3. The machine as defined in claim 2 wherein the retaining means comprises in part at least one vertical plate having formed therein at least one hole for receiving the elongated pin.

4. The machine as defined in claim 1 further comprising the compression section being formed in part with at least two poly V pulleys rotatably attached to the fixed elongated section and the pivotable elongated section and further comprising the compression section using a poly V belt for minimizing belt walking and therefore jamming of bags in the machine.

5. The machine as defined in claim 1 wherein the pivotable elongated section swings downwardly by gravity.

6. The machine as defined in claim 1 wherein the pivotable elongated section swings downwardly by a hydraulic cylinder.

7. The machine as defined in claim 1 wherein the pivotable elongated section swings downwardly by a pneumatic cylinder.

8. The machine as defined in claim 1 wherein the pivotable elongated section swings downwardly by an electric motor drive.

9. The machine as defined in claim 1 wherein the folding and heating section comprises at least two separate heating units.

10. The machine as defined in claim 9 wherein the two separate heating units are fixedly attached to the pivotable elongated section.

11. The machine as defined in claim 2 further comprising the retaining means being operable by a switch positioned in an easily accessible position on the machine for operation of the break-open cylinder.

12. A bag closing and sealing machine for a stepped end adhesively sealed bag, comprising:

(a) a frame;

(b) a fixed elongated section fixedly attached to the frame;

(c) a movable elongated section, movably attached to the frame and in juxtaposition to the fixed elongated section;

(d) means, associated with the movable elongated section, for retaining the movable elongated section in a generally horizontal operative position in juxtaposition to the fixed elongated section;

(e) a feeding and creasing section fixedly attached partly on the fixed elongated section and partly on the movable elongated section;

(f) a folding and heating section positioned downstream from the feeding and creasing section, the folding portion being fixedly attached to the fixed elongated section and the heating portion being fixedly attached to the movable elongated section;

(g) a compression section positioned downstream from the folding and heating section and fixedly attached partly on the fixed elongated section and partly on the movable elongated section; and (h) the movable elongated section being designed to move away from the fixed elongated section upon release of the retaining means thereby easily permitting the release of a jammed bag from between the two elongated sections containing the feeding and creasing section, the folding and heating section and the compression section.

* * * * *